US010368177B2

(12) United States Patent
Kishi et al.

(10) Patent No.: US 10,368,177 B2
(45) Date of Patent: Jul. 30, 2019

(54) ABNORMALITY DETECTING DEVICE, ABNORMALITY DETECTION METHOD, AND RECORDING MEDIUM STORING ABNORMALITY DETECTION COMPUTER PROGRAM

(71) Applicant: FUJITSU LIMITED, Kawasaki-shi, Kanagawa (JP)

(72) Inventors: Yohei Kishi, Kawasaki (JP); Akira Kamano, Kawasaki (JP); Masanao Suzuki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/174,178

(22) Filed: Oct. 29, 2018

(65) Prior Publication Data

US 2019/0166442 A1 May 30, 2019

(30) Foreign Application Priority Data

Nov. 29, 2017 (JP) ..... 2017-229121

(51) Int. Cl.
*H04R 29/00* (2006.01)
*G10L 25/18* (2013.01)

(52) U.S. Cl.
CPC ..... *H04R 29/00* (2013.01); *G10L 25/18* (2013.01)

(58) Field of Classification Search
CPC ..... H04R 29/00
See application file for complete search history.

(56) References Cited

U.S. PATENT DOCUMENTS

| | | | | |
|---|---|---|---|---|
| 5,710,715 A * | 1/1998 | Shitanda | ..... | G01H 1/003 702/56 |
| 10,152,877 B2 * | 12/2018 | Linder | ..... | G08B 1/08 |
| 2013/0148817 A1 * | 6/2013 | Moriya | ..... | H04R 29/00 381/56 |

FOREIGN PATENT DOCUMENTS

| | | |
|---|---|---|
| JP | 09-043283 | 2/1997 |
| JP | 10-133740 | 5/1998 |
| JP | 2010-65594 | 3/2010 |
| JP | 2013-140135 | 7/2013 |
| JP | 2013-221429 | 10/2013 |

* cited by examiner

*Primary Examiner* — Olisa Anwah
(74) *Attorney, Agent, or Firm* — Fujitsu Patent Center

(57) ABSTRACT

An abnormality detecting device includes a memory, and a processor coupled to the memory and configured to: detect an envelope of an audio signal indicating a periodic sound emitted by a target object and a periodic sound emitted by another object; execute time-to-frequency conversion on the envelope to calculate a frequency spectrum of the audio signal; and determine whether or not the target object has an abnormality, based on a frequency component included in the frequency spectrum and corresponding to a time interval between time points when the sound is emitted by the target object.

6 Claims, 10 Drawing Sheets

ABNORMALITY DETECTING DEVICE, ABNORMALITY DETECTION METHOD, AND RECORDING MEDIUM STORING ABNORMALITY DETECTION COMPUTER PROGRAM

CROSS-REFERENCE TO RELATED APPLICATION

This application is based upon and claims the benefit of priority of the prior Japanese Patent Application No. 2017-229121, filed on Nov. 29, 2017, the entire contents of which are incorporated herein by reference.

FIELD

The embodiment discussed herein is related to an abnormality detecting device, an abnormality detection method, and an abnormality detection computer program, which detect an abnormality of an object based on, for example, an audio signal.

BACKGROUND

A technique for detecting, based on an audio signal, an abnormal sound emitted by a machine such as a fan, a motor, or a compressor has been proposed. In this technique, filtering is executed on a signal received by a microphone, an envelope signal that is based on the filtered signal is generated, and a cross-spectrum of the envelope signal and the received signal is generated.

In the vicinity of a target object to be subjected to abnormality detection, another object that emits a periodic sound may exist. In this case, an audio signal collected via a microphone includes not only a sound emitted by the target object but also the sound emitted by the other object. As a result, the target object may be erroneously detected to have an abnormality due to the sound emitted by the other object.

The following is a reference document.

[Document 1] Japanese Laid-open Patent Publication No. 9-43283.

SUMMARY

According to an aspect of the embodiments, 1n abnormality detecting device includes a memory, and a processor coupled to the memory and configured to: detect an envelope of an audio signal indicating a periodic sound emitted by a target object and a periodic sound emitted by another object; execute time-to-frequency conversion on the envelope to calculate a frequency spectrum of the audio signal; and determine whether or not the target object has an abnormality, based on a frequency component included in the frequency spectrum and corresponding to a time interval between time points when the sound is emitted by the target object.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, an abnormality detecting device is described with reference to the accompanying drawings. The abnormality detecting device generates an audio signal by causing a microphone to collect a periodic sound emitted by a target object, executes frequency analysis on the audio signal, and detects an abnormality that has occurred in the target object. As described above, however, when another object that emits a periodic sound exists near the target object, the audio signal includes a component of the periodic sound (noise) emitted by the other object. For example, when the target object is a fan of an air conditioner, a compressor included in an outdoor unit emits a periodic sound.

Figure 1A:
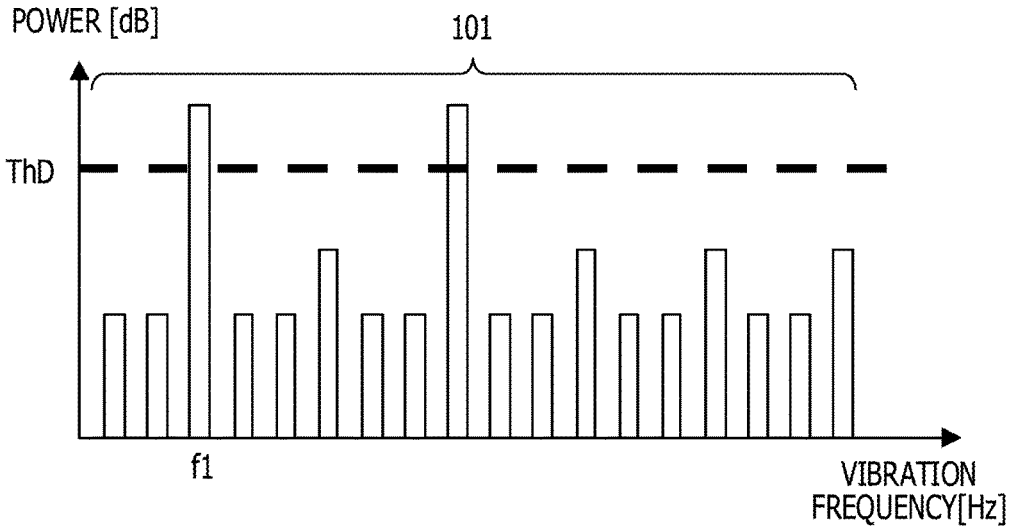
FIG. 1A is a diagram illustrating an example of a frequency spectrum obtained by executing time-to-frequency conversion on an audio signal generated by causing a microphone to collect a periodic sound emitted by a fan of an air conditioner.

FIG. 1A is a diagram illustrating an example of a frequency spectrum obtained by executing time-frequency conversion on an envelope signal of an audio signal generated by causing the microphone to collect the periodic sound emitted by the fan of the air conditioner. In FIG. 1A, an abscissa indicates a frequency, and an ordinate indicates power. In an embodiment, a frequency spectrum indicates components of frequencies that correspond to time intervals at which a sound is emitted by a rotational vibration of the fan. The frequencies are hereinafter referred to as vibration frequencies. A frequency spectrum 101 of the periodic sound emitted by the fan is expressed by a set of bars indicating power for the vibration frequencies. As indicated by the frequency spectrum 101, power of vibrations is large at a vibration frequency f1 corresponding to a time interval between vibrations generated by the fan and at integral multiples of the vibration frequency f1. When a behavior of the fan is abnormal, power of vibrations is larger than a predetermined threshold ThD at the vibration frequency f1 corresponding to the time interval between the vibrations generated by the fan and at an integral multiple of the vibration frequency f1. Thus, whether or not the fan is abnormal is detected based on power of different vibration frequencies.

Figure 1B:
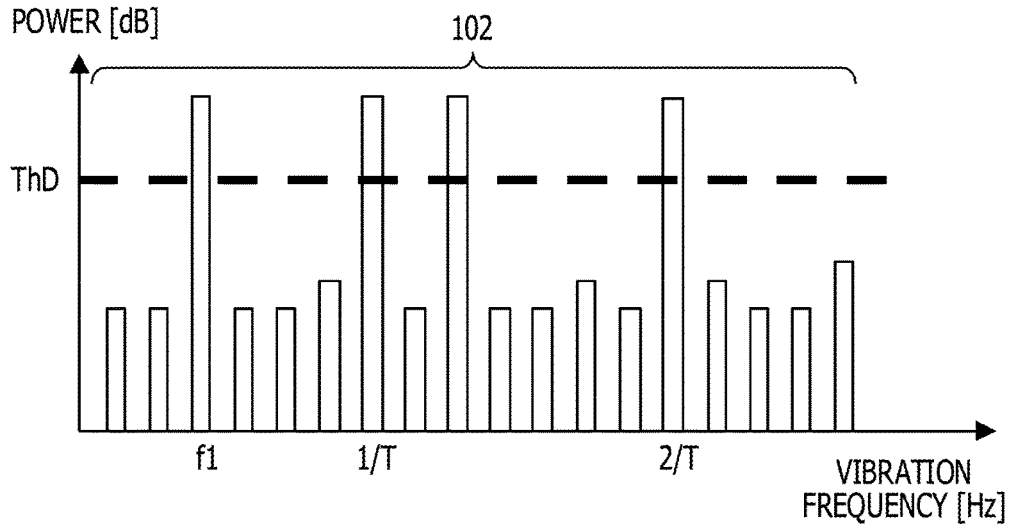
FIG. 1B is a diagram illustrating an example of a frequency spectrum obtained by causing the microphone to collect not only the periodic sound emitted by the fan of the air-conditioner but also a periodic sound emitted by a compressor included in an outdoor unit.

FIG. 1B is a diagram illustrating an example of a frequency spectrum obtained by causing the microphone to collect not only the periodic sound emitted by the fan of the air-conditioner but also a periodic sound emitted by the compressor included in the outdoor unit. In FIG. 1B, an abscissa indicates a vibration frequency, and an ordinate indicates power. A frequency spectrum 102 of an audio signal including the periodic sound emitted by the fan and the sound emitted by the compressor is indicated by a set of bars indicating power for vibration frequencies. In the frequency spectrum 102, power of vibrations is larger than the threshold ThD at not only the vibration frequency f1 and integral multiples of the vibration frequency f1 but also a vibration frequency (1/T) corresponding to a time interval T at which a sound is emitted by the compressor and a vibration frequency (2/T) that is an integral multiple of the vibration frequency (1/T). As a result, the fan may be erroneously detected to have an abnormality, based on components of vibration frequencies included in the sound emitted by the compressor.

The abnormality detecting device estimates a time interval between time points when a vibration is generated by a target object, based on a frequency spectrum calculated from an envelope signal included in an audio signal obtained by collecting a sound emitted by the target object to be subjected to abnormality detection. Then, the abnormality detecting device compares the power of a component of the frequency spectrum at a vibration frequency corresponding to the estimated time interval and the power of a component of the frequency spectrum at an integral multiple of the vibration frequency with a threshold, thereby detecting an abnormality that has occurred in the target object.

The target object from which the abnormality has been detected emits a periodic sound. In an embodiment described below, the target object is a fan having multiple blades and included in an air conditioner or the like. The fan is an example of a rotating device. A noise sound generated by another object is, for example, a periodic sound emitted by a compressor. The target object, however, may be a rotating device (for example, a motor) that is not a fan and executes a rotational operation. Alternatively, the target object may periodically reciprocate and may be a piston included in an engine or the like. In addition, the noise sound may be a periodic sound emitted by a device or the like other than the compressor.

Figure 2:
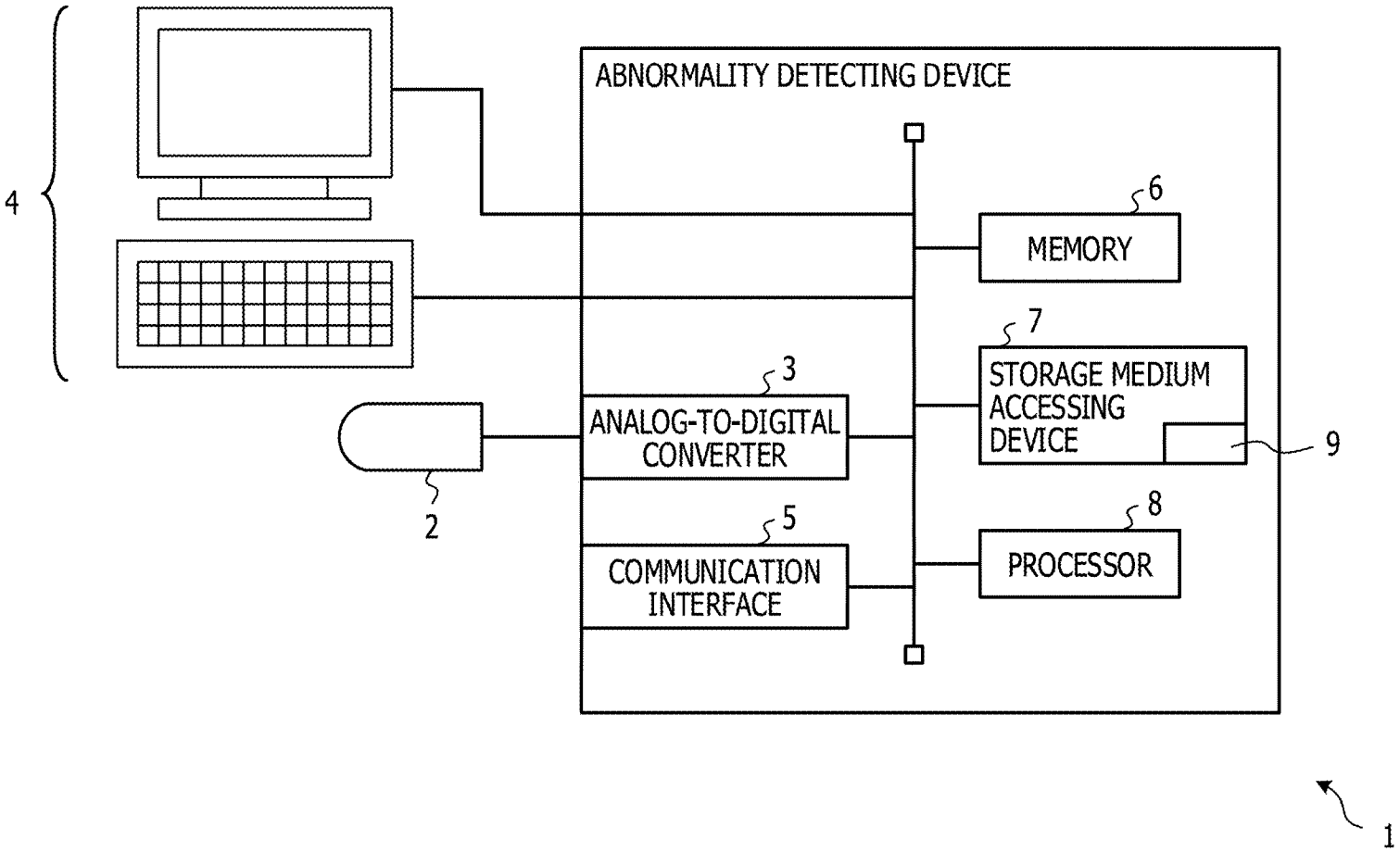
FIG. 2 is a diagram schematically illustrating a configuration of an abnormality detecting device according to an embodiment.

FIG. 2 is a schematic diagram illustrating a configuration of an abnormality detecting device according to the embodiment. The abnormality detecting device 1 is implemented as a mobile device or a computer, for example. The abnormality detecting device 1 includes a microphone 2, an analog-to-digital converter 3, a user interface 4, a communication interface 5, a memory 6, a storage medium accessing device 7, and a processor 8.

The microphone 2 is an example of a sound input unit. For example, the microphone 2 is installed near a fan to be subjected to abnormality detection. The microphone 2 collects a periodic sound emitted by the fan to generate an analog audio signal. In this case, a periodic sound emitted by a compressor positioned near the fan is collected by the microphone 2. Thus, the audio signal includes not only the sound emitted by the fan but also the sound emitted by the compressor. The audio signal generated by the microphone 2 is input to the analog-to-digital converter 3.

The analog-to-digital converter 3 samples the analog audio signal received from the microphone 2 at sampling frequencies (of, for example, 16 kHz), thereby generating a digitalized audio signal. The audio signal generated by causing the microphone 2 to collect the sound and digitalized by the analog-to-digital converter 3 is hereinafter merely referred to as audio signal.

The analog-to-digital converter 3 outputs the audio signal to the processor 8.

The user interface 4 includes a touch panel, for example. The user interface 4 generates an operation signal based on an operation by a user and outputs the operation signal to the processor 8. The operation signal is, for example, a signal to start an abnormality detection process or a signal to display an abnormality detection result. In addition, the user interface 4 displays the abnormality detection result or the like in accordance with a display signal received from the processor 8. The user interface 4 may include multiple operational buttons for inputting the operation signal and a display device such as a liquid crystal display. In this case, the operational buttons are separated from the display device.

The communication interface 5 includes a communication interface circuit or the like that connects the abnormality detecting device 1 to another device in accordance with a predetermined communication standard. In this case, for example, the other device is, for example, an air conditioner including a fan to be subjected to the abnormality detection. For example, the communication interface circuit may be a circuit that operates in accordance with a near field communication standard such as Bluetooth (registered trademark) or operates in accordance with a serial bus standard such as Universal Serial Bus (USB). The communication interface 5 outputs, to another device, information indicating the abnormality detection result received from the processor 8 and the like, for example.

The memory 6 is an example of a storage unit and includes, for example, a readable and writable semiconductor memory and a read-only semiconductor memory. The memory 6 stores various computer programs to be used by the abnormality detecting device 1 and various types of data to be used by the abnormality detecting device 1. The memory 6 stores the audio signal received from the analog-to-digital converter 3 and various signals to be used in the abnormality detection process or various types of information to be used in the abnormality detection process. In addition, the memory 6 stores various types of data generated in the middle of the abnormality detection process, the result of the abnormality detection, and the like.

The storage medium accessing device 7 is another example of the storage unit and is, for example, a device configured to access a storage medium 9 that is, for example, a semiconductor memory card, a hard disk, or an optical storage medium. The storage medium accessing device 7 reads a computer program stored in the storage medium 9 and to be executed by the processor 8 and transmits the read computer program to the processor 8.

The processor 8 is an example of a controller and includes, for example, a central processing unit (CPU) and a peripheral circuit of the CPU. The processor 8 may include a numerical processor. The processor 8 controls the entire abnormality detecting device 1.

The processor 8 executes the abnormality detecting process on the received audio signal.

Figure 3:
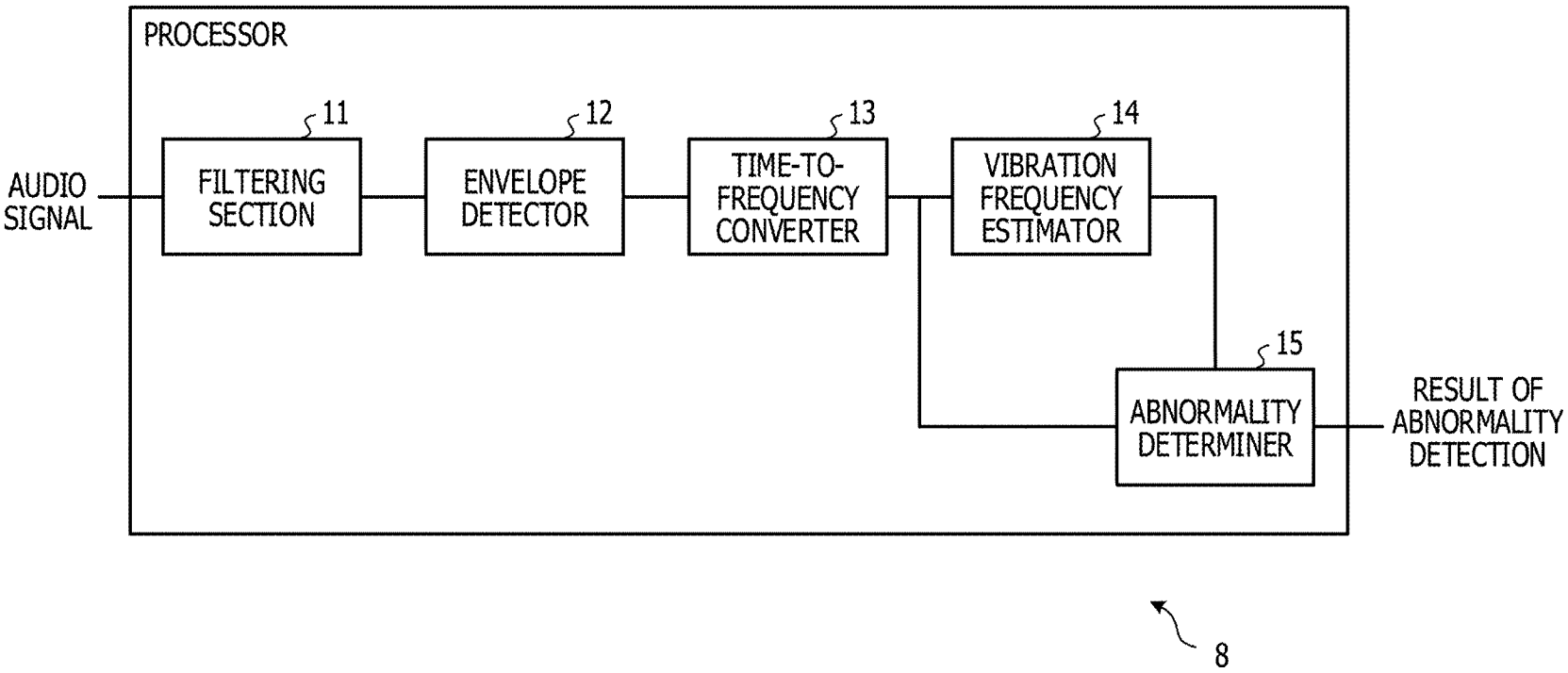
FIG. 3 is a functional block diagram of a processor included in the abnormality detecting device.

FIG. 3 is a functional block diagram of the processor 8. The processor 8 includes a filtering section 11, an envelope detector 12, a time-to-frequency converter 13, a vibration frequency estimator 14, and an abnormality determiner 15.

The sections 11 to 15 included in the processor 8 are, for example, functional modules enabled by the computer program executed by the processor 8. Alternatively, the sections 11 to 15 may be implemented as dedicated arithmetic circuits installed in a portion of the processor 8.

The filtering section 11 executes a filtering process on the audio signal so that the audio signal includes vibration frequency components of the sound emitted by the fan and that other vibration frequency components are attenuated. The filtering section 11 may attenuate a component that is included in the audio signal and whose frequency is higher than a Nyquist frequency based on the sampling frequencies of the analog-to-digital converter 3. In addition, the filtering section 11 may attenuate a vibration frequency component lower than a vibration frequency corresponding to a rotational period of the fan. Thus, the filtering section 11 filters the audio signal by applying a low-pass filter or bandpass filter, which is a finite impulse response (FIR) filter, to the audio signal, for example. The filtering section 11 may apply a filter of another type to the audio signal.

The filtering section 11 outputs the audio signal subjected to the filtering process to the envelope detector 12.

The envelope detector 12 detects an envelope of the audio signal subjected to the filtering process. Thus, for example, the envelope detector 12 detects the envelope of the audio signal subjected to the filtering process according to the following equations.

$$y(t) = F^{-1}(F(|x(t)|) \times W(f)) \tag{1}$$

$$W(f) = \begin{cases} 1 & |f| \le fb \\ 0 & |f| > fb \end{cases}$$

In Equation (1), x(t) indicates the audio signal subjected to the filtering process, and y(t) indicates the detected envelope. In addition, F( ) indicates Fast Fourier Transform (FET), and $F^{-1}$( ) indicates inverse FET. W(f) indicates a low-pass filter and is expressed as a function in a frequency region. For example, when an absolute value of a frequency f is equal to or lower than a cut-off frequency fb, W(f) is 1. When the absolute value of the frequency f is higher than the cut-off frequency fb, W(f) is 0. It is preferable that the cut-off frequency fb be set to be equal to or nearly equal to the maximum frequency among frequencies that pass through the filtering section 11.

Alternatively, the envelope detector 12 may detect the envelope of the audio signal subjected to the filtering process using Hilbert transformation according to the following equations.

$$y(t) = |\hat{x}(t)| \tag{2}$$

$$\hat{x}(t) = \begin{cases} F^{-1}(-j \times F(x(t))) & f > 0 \\ 0 & f = 0 \\ F^{-1}(+j \times F(x(t))) & f < 0 \end{cases}$$

The envelope detector 12 outputs the detected envelope to the time-to-frequency converter 13.

The time-to-frequency converter 13 executes time-to-frequency conversion on the detected envelope from a time region to a frequency region on a frame basis, thereby calculating a frequency spectrum of the audio signal so that the frequency spectrum includes an amplitude component and a phase component for each of multiple vibration frequencies.

In the embodiment, to detect an abnormality caused by a rotational vibration of the fan, it is preferable that a sufficiently accurate frequency spectrum be calculated in a frequency region from 0 to a vibration frequency corresponding to a value obtained by multiplying a rotational speed of the fan by the number of blades of the fan. Thus, for example, it is preferable that resolution in the frequency region be approximately 1 Hz. For example, when the sampling frequencies of the analog-to-digital converter 3 are 16 kHz, it is preferable that a frame length be equal to or longer than a length corresponding to 16384 samples.

The time-to-frequency converter 13 calculates the frequency spectrum by converting a frame set for the envelope from a time region to a frequency region. It is sufficient if the time-to-frequency converter 13 calculates the frequency spectrum by executing time-to-frequency conversion such as FFT on the frame, for example.

The time-to-frequency converter 13 outputs the calculated frequency spectrum to the vibration frequency estimator 14 and the abnormality determiner 15.

The vibration frequency estimator 14 estimates the vibration frequency corresponding to the rotational period of the fan based on the frequency spectrum.

A frequency spectrum of a sound generated due to a rotational vibration of the fan includes components with relatively high power at the vibration frequency corresponding to the rotation period of the fan and at a vibration frequency obtained by multiplying the vibration frequency corresponding to the rotation period of the fan by the number of blades of the fan.

Thus, the vibration frequency estimator 14 detects peaks from the frequency spectrum and calculates, for each of combinations, each of which includes two peaks among the detected peaks, the ratio of higher one of vibration frequencies corresponding to the peaks of the combination to lower one of the vibration frequencies corresponding to the peaks of the combination. Then, the vibration frequency estimator 14 identifies, from the combinations, a combination of peaks corresponding to vibration frequencies whose ratio is closest to the number of blades of the fan, and the vibration frequency estimator 14 treats a lower vibration frequency corresponding to one of the peaks of the identified combination as the vibration frequency corresponding to the rotational period of the fan. This example assumes that the number of blades of the fan is known.

Figure 4:
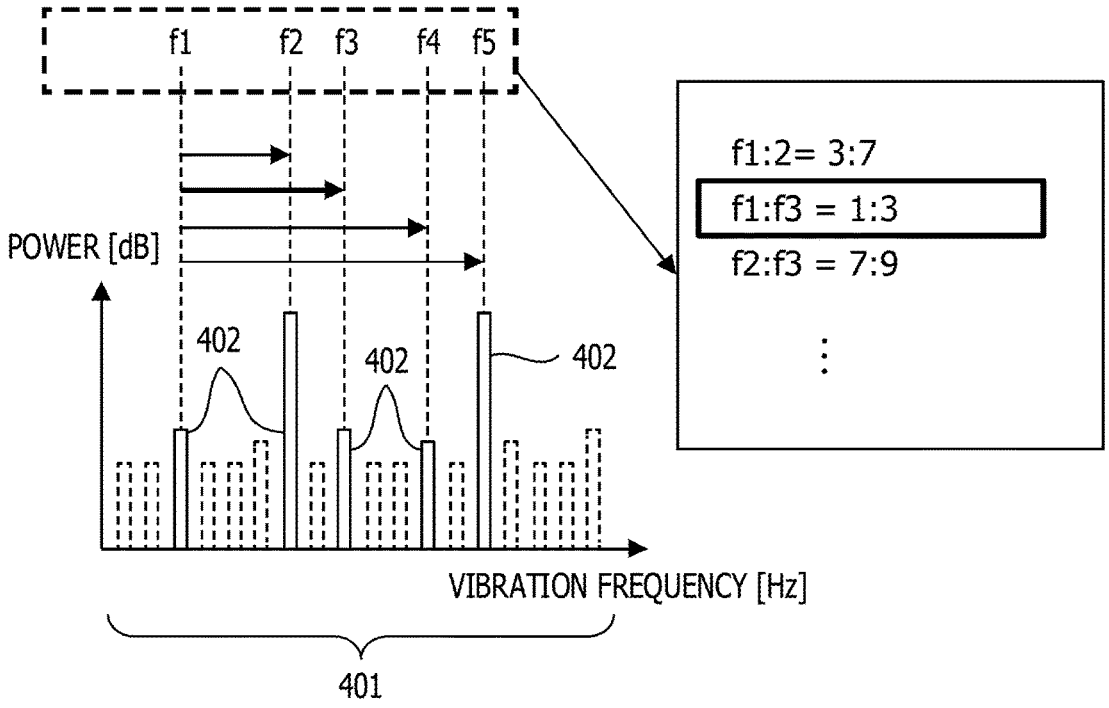
FIG. 4 is a schematic diagram describing the estimation of a vibration frequency corresponding to a rotational period of a fan.

FIG. 4 is a schematic diagram describing the estimation of the vibration frequency corresponding to the rotational period of the fan. In FIG. 4, an abscissa indicates a vibration frequency and an ordinate indicates power. A frequency spectrum 401 of an envelope of an audio signal obtained by the microphone 2 is expressed by a set of bars indicating power at vibration frequencies. This example assumes that the number of blades of the fan is 3.

Peaks 402 at vibration frequencies f1 to f5 are extracted from the frequency spectrum 401. Then, ratios (f2/f1, f3/f1, f3/f2, and the like) of the vibration frequencies corresponding to the peaks to the other vibration frequencies corresponding to the other peaks are calculated for combinations, each of which includes two peaks among the extracted peaks 402. In this example, the ratio (f3/f1) is closest to "3" that is the number of blades of the fan. Thus, the vibration frequency f1 is estimated as the vibration frequency corresponding to the rotational period of the fan.

To detect peaks from the frequency spectrum, the vibration frequency estimator 14 compares, for each of the vibration frequencies of the frequency spectrum, the power of a component at the target vibration frequency with the power of a component at a vibration frequency immediately adjacent to the target vibration frequency. Then, for example, the vibration frequency estimator 14 detects, as a peak, a certain vibration frequency at which the power of a component is larger than the power of a component at a vibration frequency immediately adjacent to the certain vibration frequency by a peak detection threshold or more or detects, as the peak, a vibration frequency satisfying the following requirement.

$$Pf(k)=f, \text{ however } \{P(f)-P(f-1)\}\geq Thp \text{ and } \{P(f)-P(f+1)\}\geq ThP \quad (3)$$

In Equation (3), P(f−1), P(f), P(f+1) indicate power of components at vibration frequencies (f−1), f, and (f+1) included in the frequency spectrum. Thp indicates the peak detection threshold and is set to, for example, 1 dB. Pf(k) indicates a vibration frequency corresponding to a k-th peak (k=1, 2, . . . ) in ascending order of vibration frequency.

Figure 5:
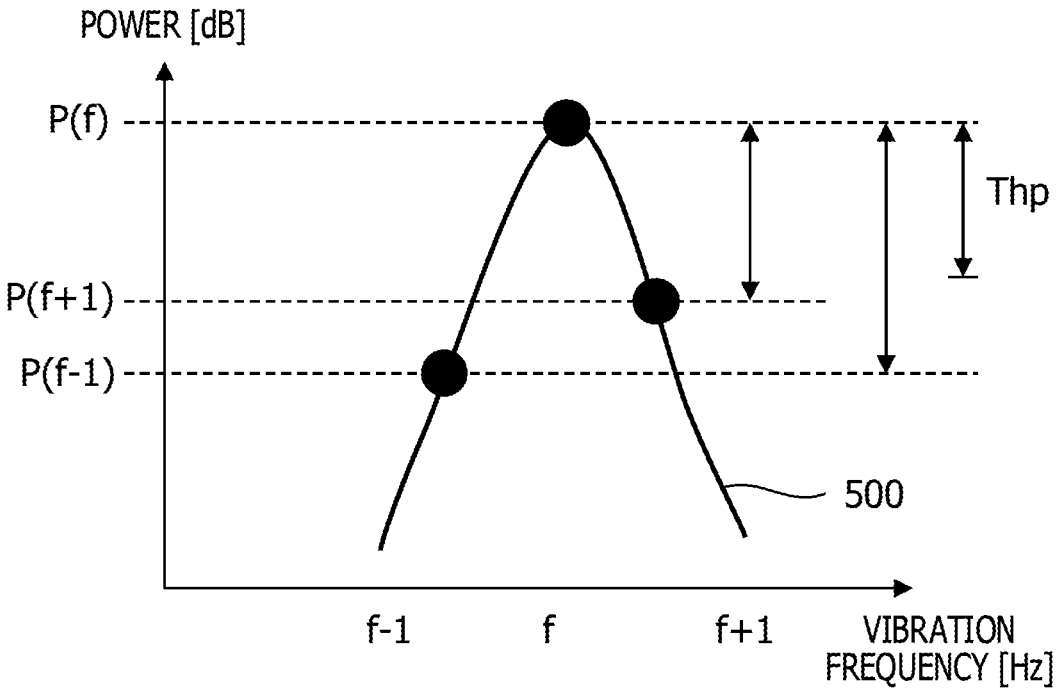
FIG. 5 is a schematic diagram describing peak detection.

FIG. 5 is a schematic diagram describing the peak detection. In FIG. 5, an abscissa indicates a vibration frequency and an ordinate indicates power. A waveform 500 indicates a frequency spectrum. In this example, power P(f) at a vibration frequency f is larger than power P(f−1) at the vibration frequency (f−1) and power P(f+1) at the vibration frequency (f+1) by the peak detection threshold Thp or more. Thus, the vibration frequency f is used as a peak.

After the vibration frequency estimator 14 detects the peaks, the vibration frequency estimator 14 calculates, for each of combinations of the peaks, the ratio of a vibration frequency corresponding to one of peaks of the combination to a vibration frequency corresponding to the other of the peaks of the combination according to the following equation.

$$R(l)=Pf(j)/Pf(i), \text{ however } Pf(j)>Pf(i) \quad (4)$$

In Equation (4), R(l) (l=1, 2, . . . , ${}_{M}C_{2}$, M is the number of all detected peaks) indicates the ratio of vibration frequencies calculated for an l-th combination of peaks including an i-th peak and a j-th peak (however, Pf(j)>Pf(i)).

The vibration frequency estimator 14 identifies a combination of peaks corresponding to vibration frequencies whose ratio, which is among ratios R(l) of vibration frequencies that have been calculated for combinations of peaks, is closest to the number N of blades of the fan. Specifically, the vibration frequency estimator 14 identifies the combination of the peaks corresponding to the vibration frequencies whose ratio satisfies the following formula.

$$\min_{l}(|R(l)-N|) \quad (5)$$

Then, the vibration frequency estimator 14 estimates, as the vibration frequency corresponding to the rotational period of the fan, lower one of the vibration frequencies corresponding to the two peaks included in the identified combination. The vibration frequency estimator 14 notifies the estimated vibration frequency corresponding to the rotational period of the fan to the abnormality determiner 15.

The abnormality determiner 15 compares an abnormality determination threshold with the power of a component at the vibration frequency corresponding to the rotational period of the fan and the power of a component at an integral multiple of the vibration frequency corresponding to the rotational period of the fan. This is due to the fact that an abnormal sound generated due to a behavior of the fan is estimated to depend on the rotational period of the fan. When the power of the component at the vibration frequency corresponding to the rotational period of the fan or the power of the component at the integral multiple of the vibration frequency corresponding to the rotational period of the fan is equal to or higher than the abnormal determination threshold, the abnormal determiner 15 determines that an abnormal sound has been emitted and that the fan has an abnormality. The abnormality determination threshold is set to, for example, 3 dB. On the other hand, when the power of the component at the vibration frequency corresponding to the rotational period of the fan and the power of the component at the integral multiple of the vibration frequency corresponding to the rotational period of the fan are lower than the abnormal determination threshold, the abnormality determiner 15 determines that an abnormal sound has not been emitted and that the fan does not have an abnormality. The abnormality determiner 15 may compare absolute values of amplitude components at the aforementioned vibration frequencies with the abnormality determination threshold, instead of comparing the power of the components at the vibration frequencies with the abnormality determination threshold. When any of the absolute values of the amplitude components at the vibration frequencies is equal to or higher than the abnormality determination threshold, the abnormality determiner 15 may determine that the fan has an abnormality.

Figure 6:
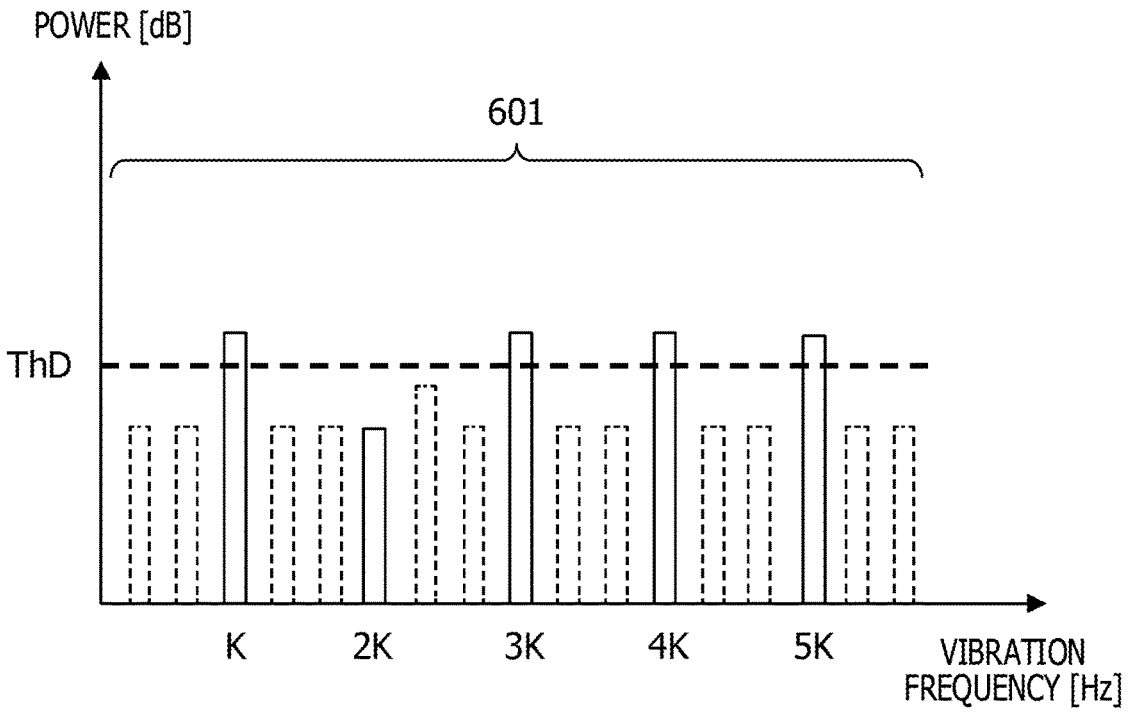
FIG. 6 is a schematic diagram describing abnormality determination.

FIG. 6 is a schematic diagram describing the abnormality determination. In FIG. 6, an abscissa indicates a vibration frequency and an ordinate indicates power. A frequency spectrum 601 of an audio signal obtained by the microphone 2 is expressed by a set of bars indicating power at vibration frequencies. In this example, a vibration frequency K is the vibration frequency corresponding to the rotational period of the fan. Thus, power at vibration frequencies K, 2K, 3K, . . . is compared with the abnormality determination threshold. In this example, since power of components at the vibration frequencies K, 3K, 4K, and 5K is equal to or higher than the abnormality determination threshold ThD, the abnormality determiner 15 determines that the fan has an abnormality.

The abnormality determiner 15 causes the user interface 4 to display the result of the abnormality detection. Alternatively, the abnormality determiner 15 may generate a signal including the result of the abnormality detection and output the generated signal to another device via the communication interface 5.

Figure 7:
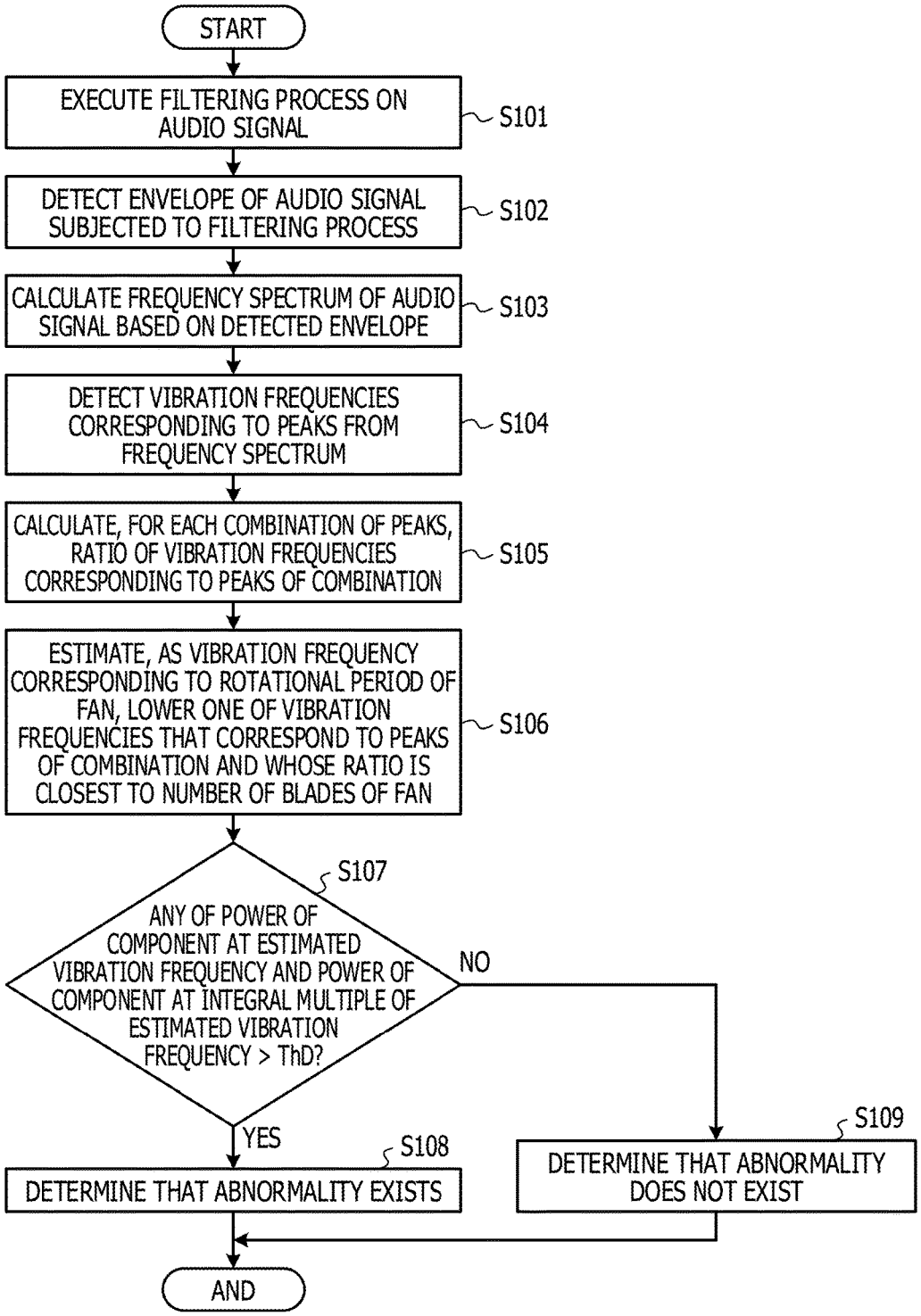
FIG. 7 is an operational flowchart of an abnormality detection process.

FIG. 7 is an operational flowchart of the abnormality detection process. Upon receiving an audio signal corresponding to a frame length, the processor 8 executes the abnormality detection process in accordance with the operational flowchart of FIG. 7.

The filtering section 11 executes the filtering process on an audio signal including a sound emitted by the fan and collected by the microphone 2 so that the audio signal includes a vibration frequency component of the sound emitted by the fan and that a vibration frequency component other than the vibration frequency component of the sound emitted by the fan is attenuated (in step S101). Then, the envelope detector 12 detects an envelope of the audio signal subjected to the filtering process (in step S102).

The time-to-frequency converter 13 calculates a frequency spectrum of the audio signal by converting a frame set for the detected envelope from a time region to a frequency region on a frame basis (in step S103).

The vibration frequency estimator 14 detects vibration frequencies corresponding to peaks from the frequency spectrum (in step S104). After the vibration frequency estimator 14 detects the vibration frequencies corresponding to the peaks, the vibration frequency estimator 14 calculates, for each of combinations of the peaks, the ratio of a vibration frequency corresponding to one of peaks of the combination to a vibration frequency corresponding to the other of the peaks of the combination (in step S105). Then, the vibration frequency estimator 14 identifies a combination of peaks corresponding to vibration frequencies whose ratio is among the ratios calculated for the combinations of the peaks and is closest to the number of blades of the fan. The vibration frequency estimator 14 estimates, as the vibration frequency corresponding to the rotational period of the fan, lower one of the vibration frequencies corresponding to the peaks included in the identified combination (in step S106).

The abnormality determiner 15 determines whether or not the power of a component included in the frequency spectrum at the estimated vibration frequency corresponding to the rotational period of the fan or the power of a component included in the frequency spectrum at an integral multiple of the estimated vibration frequency is equal to or higher than the abnormality determination threshold ThD (in step S107). When the power of the component at the estimated vibration frequency corresponding to the rotational period of the fan or the power of the component at the integral multiple of the estimated vibration frequency is equal to or higher than the abnormality determination threshold ThD (Yes in step S107), the abnormality determiner 15 determines that the fan has an abnormality (in step S108). Then, the abnormality determiner 15 causes the user interface 4 to display an abnormality detection result indicating that the fan has the abnormality.

On the other hand, when the power of the component at the estimated vibration frequency corresponding to the rotational period of the fan and the power of the component at the integral multiple of the estimated vibration frequency are lower than the abnormality determination threshold ThD (No in step S107), the abnormality determiner 15 determines that the fan does not have an abnormality (in step S109). Then, the abnormality determiner 15 causes the user interface 4 to display an abnormality detection result indicating that the fan does not have an abnormality.

After step S108 or step S109, the processor 8 terminates the abnormality detection process.

As described above, the abnormality detecting device estimates the vibration frequency corresponding to the rotational period of the fan based on peaks detected from a frequency spectrum of an audio signal indicating a sound emitted by the fan. Then, the abnormality detecting device determines whether or not the fan has an abnormality, based on the levels of components included in the frequency spectrum at the vibration frequency corresponding to the rotational period of the fan and at an integral multiple of the vibration frequency corresponding to the rotational period of the fan. Thus, even when an object that is the compressor or the like and emits periodic noise exists near the fan, the abnormality detecting device may accurately detect an abnormality that has occurred in the fan.

According to a modified example, the number of blades of the fan may not be known. The abnormality detecting device may estimate the number of blades of the fan based on a frequency spectrum calculated from a first time region that is included in an audio signal and during which the fan and another object operate and a frequency spectrum calculated from a second time region that is included in the audio signal and during which objects other than the fan do not operate. For example, regarding the air conditioner, since hot air generated due to an operation of the compressor is discharged from an unit including the compressor to the outside of the unit, a time zone during which only the fan operates without an operation of the compressor exists before the start of the operation of the compressor or after the start of the operation of the compressor. A time region in which a sound collected in a time zone during which the fan and the compressor operate is included may be set to the first time region, while a time region in which a sound collected in a time zone during which the fan operates and the compressor does not operate is included may be set to the second time region. The start and end time of the first time region and the start and end time of the second time region may be input by the user via the user interface 4.

In this case, the time-to-frequency converter 13 calculates a first frequency spectrum by executing time-to-frequency conversion on a frame included in the first time region and calculates a second frequency spectrum by executing time-to-frequency conversion on a frame included in the second time region. Then, the time-to-frequency converter 13 outputs the first frequency spectrum to the vibration frequency estimator 14 and the abnormality determiner 15. In addition, the time-to-frequency converter 13 outputs the second frequency spectrum to the vibration frequency estimator 14.

The vibration frequency estimator 14 estimates the number of blades of the fan based on the first frequency spectrum and the second frequency spectrum. Since the number of blades of the fan is a fixed value, it is estimated that the power of a sound emitted by the fan is high at the vibration frequency corresponding to the rotational period of the fan and a vibration frequency obtained by multiplying the vibration frequency corresponding to the rotational period of the fan by the number of blades of the fan in the first time region and the second time region.

Thus, the vibration frequency estimator 14 detects peaks from the first frequency spectrum and the second frequency spectrum and calculates ratios of vibration frequencies for each of combinations of the peaks in the same manner as described in the embodiment. Then, the vibration frequency estimator 14 identifies, from combinations of peaks detected from the first frequency spectrum, a combination of peaks corresponding to vibration frequencies whose ratio matches the ratio of vibration frequencies corresponding to a combination of peaks among combinations of peaks detected from the second frequency spectrum. The vibration frequency estimator 14 treats, as the number of blades of the fan, an integer closest to the ratio of the vibration frequencies that has been calculated for the identified combination of the peaks.

Figure 8:
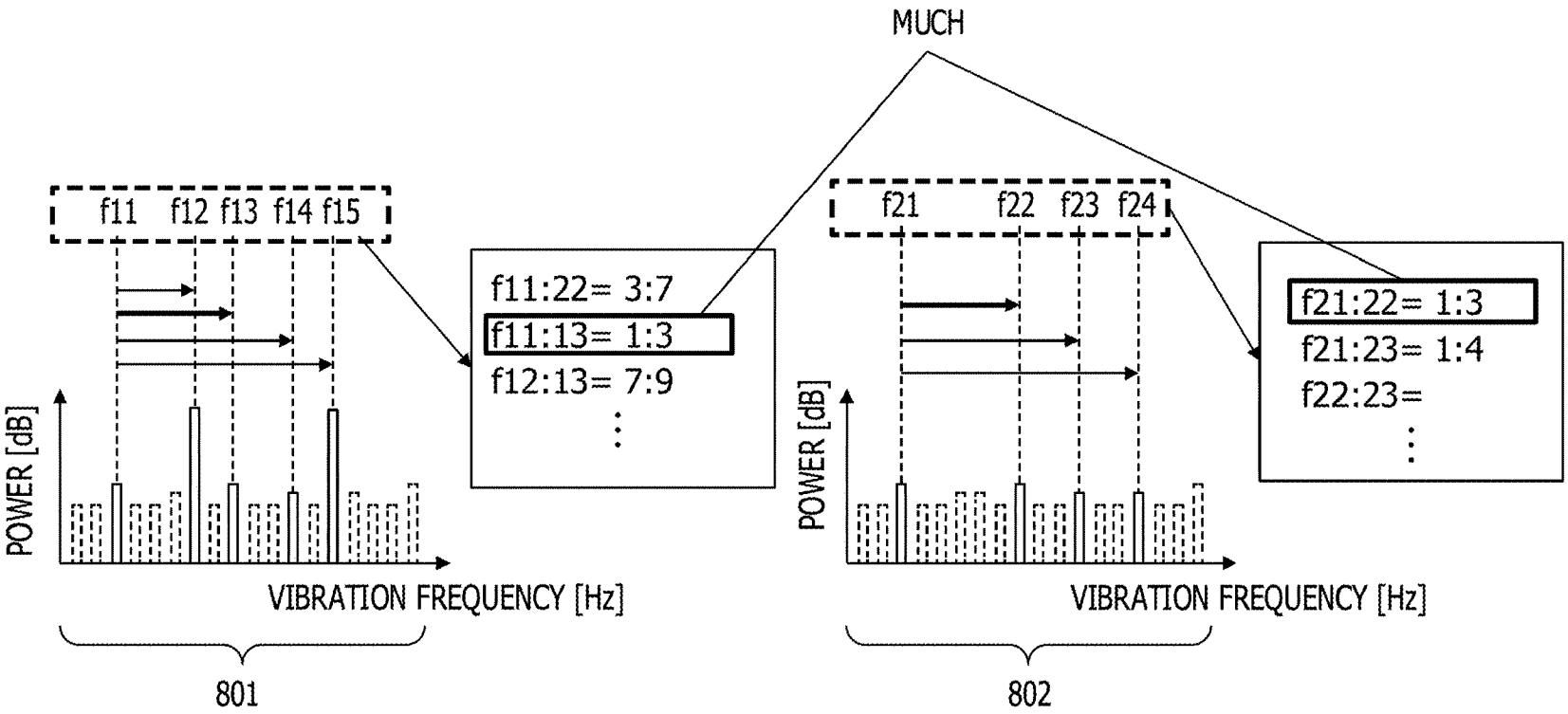
FIG. 8 is a schematic diagram describing the estimation of the number of blades.

FIG. 8 is a schematic diagram describing the estimation of the number of blades. In FIG. 8, an abscissa indicates a vibration frequency and an ordinate indicates power. In a left graph, a first frequency spectrum 801 is expressed by a set of bars indicating power at vibration frequencies. In a right graph, a second frequency spectrum 802 is expressed by a set of bars indicating power at the vibration frequencies.

Vibration frequencies f11 to f15 are detected as peaks from the first frequency spectrum 801. For each of combinations of the peaks detected from the first frequency spectrum 801, the ratio of a vibration frequency corresponding to one of peaks of the combination to a vibration frequency corresponding to the other of the peaks of the combination is calculated. Similarly, vibration frequencies f21 to f24 are detected as peaks from the second frequency spectrum 802. For each of combinations of the peaks detected from the second frequency spectrum 802, the ratio of a vibration frequency corresponding to one of peaks of the combination to a vibration frequency corresponding to the other of the peaks of the combination is calculated. In this example, the ratio of vibration frequencies corresponding to a combination (f11 and f13) of peaks detected from the first frequency spectrum 801 and the ratio of vibration frequencies corresponding to a combination (f21 and f22) of peaks detected from the second frequency spectrum 802 are "3" and match each other. Thus, the number of blades of the fan is estimated to be "3".

The vibration frequency estimator 14 may use the number of blades of the fan to estimate the vibration frequency corresponding to the rotational period of the fan based on the first frequency spectrum in the same manner as described in the embodiment. Then, the abnormality determiner 15 may detect an abnormality by executing the same processes as described in the embodiment on the first frequency spectrum.

Figure 9:
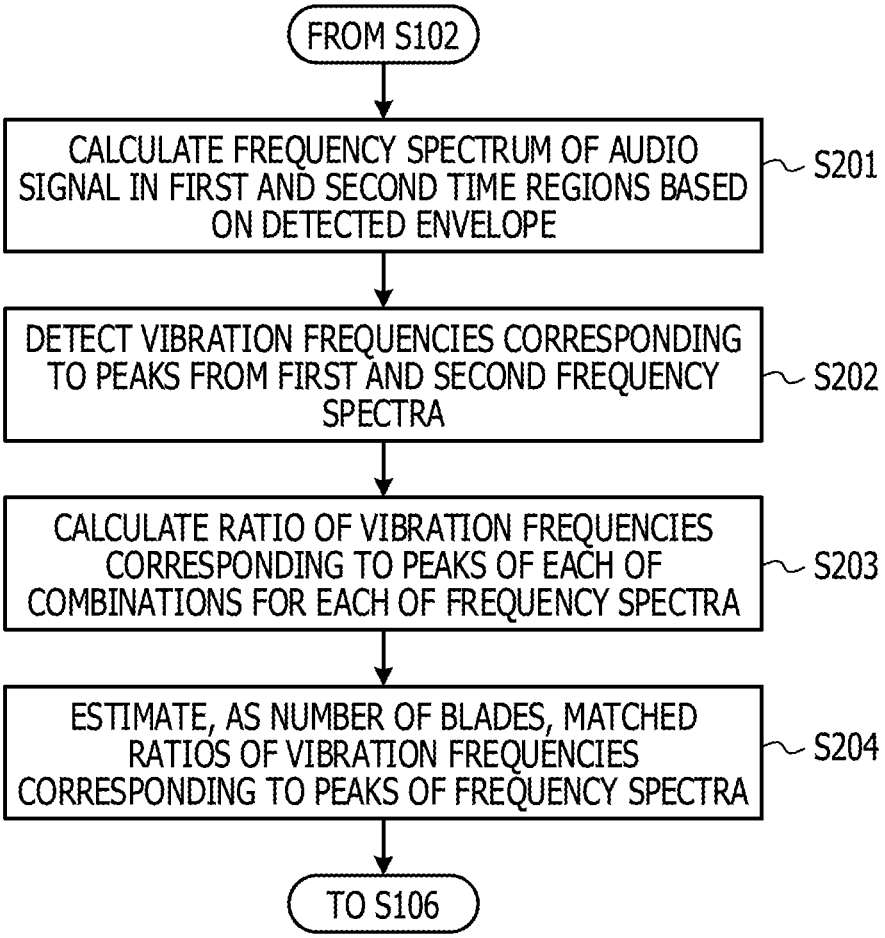
FIG. 9 is an operational flowchart of an abnormality detection process according to a modified example.

FIG. 9 is an operational flowchart of an abnormality detection process according to the modified example. In the abnormality detection process according to the modified example, processes of steps illustrated in FIG. 9 are executed instead of the processes of steps S103 to S105 included in the operational flowchart illustrated in FIG. 7. The processes of the steps illustrated in FIG. 9 are described below. In the abnormality detection process according to the modified example, the processes of steps S106 and S107 included in the operational flowchart illustrated in FIG. 7 may be executed on the first frequency spectrum.

When an envelope is detected in step S102, the time-to-frequency converter 13 calculates the first frequency spectrum from a frame included in the first time region and calculates the second frequency spectrum from a frame included in the second time region (in step S201).

The vibration frequency estimator 14 detects vibration frequencies corresponding to peaks from the first frequency spectrum and the second frequency spectrum (in step S202). The vibration frequency estimator 14 calculates, for each of combinations of the peaks detected from the frequency spectra, the ratio of a vibration frequency corresponding to one of peaks of the combination to a vibration frequency corresponding to the other of the peaks of the combination (in step S203). Then, the vibration frequency estimator 14 identifies a combination of peaks that have been detected from one of the frequency spectra and correspond to vibration frequencies whose ratio matches the ratio of vibration frequencies corresponding to peaks detected from the other of the frequency spectra, and the vibration frequency estimator 14 estimates, as the number of blades of the fan, the ratio of the vibration frequencies corresponding to the peaks of the identified combination (in step S204). After step S204, the processor 8 executes the processes of steps S106 and later included in the operational flowchart illustrated in FIG. 7.

According to the modified example, the abnormality detecting device may detect an abnormality of the fan even when the number of blades of the fan is not known.

According to another modified example, the abnormality determiner 15 may compare the abnormality determination threshold with the power of a component at the vibration frequency corresponding to the rotational period of the fan and the power of a component at a vibration frequency obtained by multiplying the vibration frequency corresponding to the rotational period of the fan by the number of blades of the fan. In this case, the abnormality determiner 15 may estimate the cause of an abnormality of the fan based on a vibration frequency at which the power of a component is equal to or higher than the abnormality determination threshold.

Figure 10:
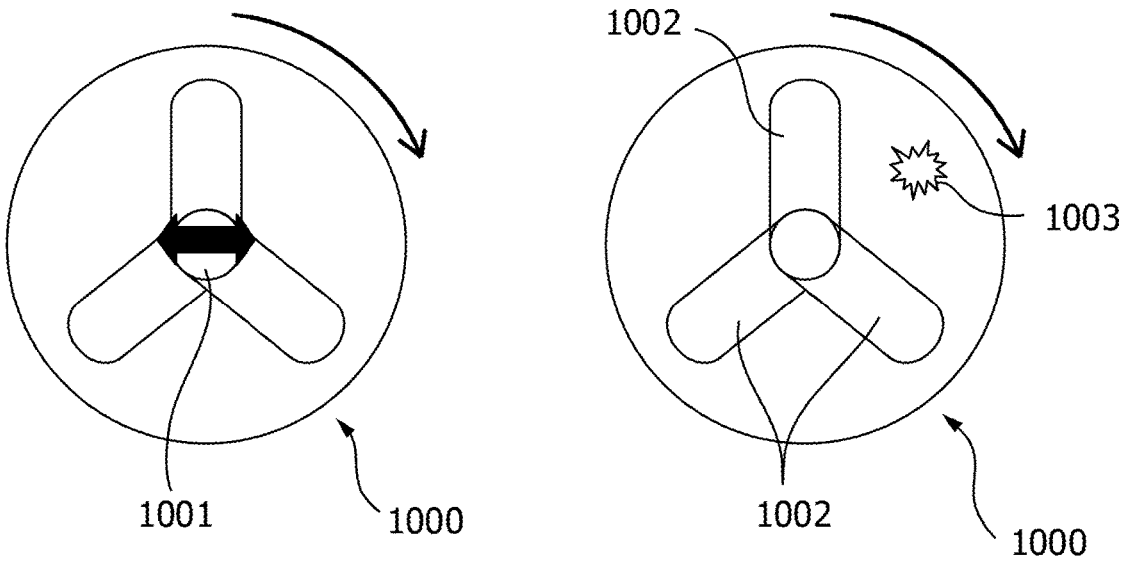
FIG. 10 is a diagram illustrating an example of relationships between rotational vibrations of the fan and time intervals between time points when an abnormal sound is emitted.

FIG. 10 is a diagram illustrating an example of relationships between rotational vibrations of the fan and a time interval between time points when an abnormal sound is emitted. In an example illustrated on the left side of FIG. 10, a shaft 1001 of a fan 1000 is vibrated due to the rotation of the fan 1000. As a result, an abnormal sound is emitted by the fan 1000. In this case, a time interval between time points when the shaft 1001 is vibrated is nearly equal to a rotational period of the fan 1000. Thus, a time interval between time points when an abnormal sound is emitted by the fan 1000 is nearly equal to the rotational period of the fan 1000. Thus, in a frequency spectrum, a component corresponding to the abnormal sound is at a vibration frequency corresponding to the rotational period of the fan 1000.

In an example illustrated on the right side of FIG. 10, when each of blades 1002 of the fan 1000 collides with an abnormal object 1003, the fan 1000 emits an abnormal sound. Thus, a time interval between time points when an abnormal sound is emitted is a period obtained by dividing the rotational period of the fan 1000 by the number of blades 1002 of the fan 1000. Thus, in a frequency spectrum, a component corresponding to the abnormal sound is at a vibration frequency obtained by multiplying the vibration frequency corresponding to the rotational period of the fan 1000 by the number of blades 1002 of the fan 1000.

For example, when a vibration frequency at which the power of a component is equal to or higher than the abnormality determination threshold is equal to the vibration frequency corresponding to the rotational period of the fan, the abnormal determiner 15 may estimate that an abnormality is caused by a vibration of the shaft of the fan. When a vibration frequency at which the power of a component is equal to or higher than the abnormality determination threshold is equal to a vibration frequency obtained by multiplying the vibration frequency corresponding to the rotational period of the fan by the number of blades of the fan, the abnormality determiner 15 may estimate that an abnormality of the fan is caused by the collision of a blade with an abnormal object. The abnormality determiner 15 may cause the user interface 4 to display the result of the abnormality detection and the estimated cause of the abnormality.

According to this modified example, since the abnormality detecting device limits vibration frequencies to be used for the determination of the abnormality detection, it may be possible to appropriately inhibit the fan from being erroneously detected to have an abnormality based on a periodic sound emitted by another object. In addition, the abnormality detecting device may present an estimated cause of an abnormality to the user.

According to another modified example, the time-to-frequency converter 13 may execute the same processes as described in the embodiment and calculate a frequency spectrum for each of multiple frames included in an audio signal. In addition, the vibration frequency estimator 14 may execute the same processes as described in the embodiment on the frequency spectra of the frames and identify the vibration frequency corresponding to the rotational period of the fan. Furthermore, the abnormality determiner 15 may compare, for each of the frames, the abnormality determination threshold with the power of a component at the vibration frequency corresponding to the rotational period of the fan and the power of a component at an integral multiple of the vibration frequency corresponding to the rotational period of the fan. When the number of frames in which the power of a component at any of the vibration frequency corresponding to the rotational period of the fan and the integral multiple of the vibration frequency corresponding to the rotational period of the fan is equal to or higher than the abnormality determination threshold is equal to or larger than a predetermined number, the abnormality determiner 15 may determine that the fan has an abnormality. The predetermined number is set to an integer of 2 or more or is, for example, set to ⅓ to ½ of the number of frames for which the frequency spectra are calculated.

According to this modified example, since the abnormality detecting device determines whether or not the fan has an abnormality by determining whether or not a vibration frequency component having power equal to or higher than the abnormality determination threshold is included in each of multiple frames, an abnormality of the fan may be accurately detected.

According to another modified example, the abnormality detecting device may acquire, from a device having a target object to be subjected to the abnormal detection or from the air conditioner having the fan, information indicating a time interval between time points when a sound is emitted by the target object, for example, information indicating the rotational period of the fan. Then, the abnormality determiner 15 may determine whether or not the target object has an abnormality by comparing the abnormality determination threshold with power of vibration frequency components at a vibration frequency identified based on the acquired information and an integral multiple of the identified vibration frequency. In this case, the vibration frequency estimator 14 may be omitted. In this modified example, the abnormality detecting device may not execute the process of estimating a vibration frequency based on a time interval between time points when a sound is emitted by the target object, and the amount of computation may be reduced.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An abnormality detecting device comprising:

a memory; and a processor coupled to the memory and configured to:

detect an envelope of an audio signal indicating a periodic sound emitted by a target object and a periodic sound emitted by another object;

execute time-to-frequency conversion on the envelope to calculate a frequency spectrum of the audio signal; and determine whether or not the target object has an abnormality, based on a frequency component included in the frequency spectrum and corresponding to a time interval between time points when the sound is emitted by the target object, wherein the target object is a rotating device having a predetermined number of blades, and wherein the processor is further configured to detect multiple peaks of the frequency spectrum, calculate, for each of combinations, each of which includes two peaks among the multiple peaks, the ratio of a frequency corresponding to one of two peaks included in the combination to a frequency corresponding to the other of the two peaks included in the combination, and estimate, as a frequency corresponding to the time interval between the time points when the sound is emitted by the target object, lower one of frequencies corresponding to two peaks included in a combination that is among the combinations and causes the difference between the ratio of the frequencies corresponding to the peaks of the combination and the predetermined number of blades to be the smallest among differences between the ratios calculated for the combinations and the predetermined number of blades.

2. The abnormality detecting device according to claim 1, wherein the processor is further configured to execute time-to-frequency conversion on the envelope in a first time region in which the sound emitted by the target object and the sound emitted by the other object are included in the audio signal so as to calculate the frequency spectrum, and execute time-to-frequency conversion on the envelope in a second time region in which the sound emitted by the target object is included and the sound emitted by the other object is not included in the audio signal so as to calculate a second frequency spectrum, and wherein the processor is further configured to detect multiple peaks of the second frequency spectrum, calculate, for each of combinations, each of which includes two peaks among the multiple peaks, a second ratio of a frequency corresponding to one of two peaks included in the combination to a frequency corresponding to the other of the two peaks included in the combination, and estimate, as the predetermined number of blades of the rotating device, a ratio that is among the ratios of the frequencies corresponding to the peaks, detected from the frequency spectrum, of the combinations and matches any of the second ratios of the frequencies corresponding to the peaks, detected from the second frequency spectrum, of the combinations.

3. The abnormality detecting device according to claim 2, wherein the processor is further configured to determine that the target object has an abnormality when any of the power of a component of the frequency spectrum at the frequency corresponding to the time interval between the time points when the sound is emitted by the target object and the power of a component of the frequency spectrum at the integral multiple of the frequency corresponding to the time interval between the time points when the sound is emitted by the target object is equal to or higher than a predetermined threshold.

4. The abnormality detecting device according to claim 3, wherein the processor is further configured to estimate a cause of an abnormality of the target object based on a frequency at which the power of a component of the frequency spectrum is equal to or higher than the predetermined threshold.

5. An abnormality detection method, comprising:

detecting an envelope of an audio signal indicating a periodic sound emitted by a target object, which is a rotating device having a predetermined number of blades, and a periodic sound emitted by another object;

executing time-to-frequency conversion on the envelope to calculate a frequency spectrum of the audio signal;

determining whether or not the target object has an abnormality, based on a frequency component included in the frequency spectrum and corresponding to a time interval between time points when the sound is emitted by the target object;

detecting multiple peaks of the frequency spectrum;

calculating, for each of combinations, each of which includes two peaks among the multiple peaks, the ratio of a frequency corresponding to one of two peaks included in the combination to a frequency corresponding to the other of the two peaks included in the combination; and estimating, as a frequency corresponding to the time interval between the time points when the sound is emitted by the target object, lower one of frequencies corresponding to two peaks included in a combination that is among the combinations and causes the difference between the ratio of the frequencies corresponding to the peaks of the combination and the predetermined number of blades to be the smallest among differences between the ratios calculated for the combinations and the predetermined number of blades.

6. A non-transitory computer-readable recording medium storing a program for causing a computer to execute a process, the process comprising:

detecting an envelope of an audio signal indicating a periodic sound emitted by a target object, which is a rotating device having a predetermined number of blades, and a periodic sound emitted by another object;

executing time-to-frequency conversion on the envelope to calculate a frequency spectrum of the audio signal;

determining whether or not the target object has an abnormality, based on a frequency component included in the frequency spectrum and corresponding to a time interval between time points when the sound is emitted by the target object;

detecting multiple peaks of the frequency spectrum;

calculating, for each of combinations, each of which includes two peaks among the multiple peaks, the ratio of a frequency corresponding to one of two peaks included in the combination to a frequency corresponding to the other of the two peaks included in the combination; and estimating, as a frequency corresponding to the time interval between the time points when the sound is emitted by the target object, lower one of frequencies corresponding to two peaks included in a combination that is among the combinations and causes the difference between the ratio of the frequencies corresponding to the peaks of the combination and the predetermined number of blades to be the smallest among differences between the ratios calculated for the combinations and the predetermined number of blades.

* * * * *